US005909976A

United States Patent [19]

Maeda

[11] Patent Number: 5,909,976

[45] Date of Patent: Jun. 8, 1999

[54] BRUSH-EQUIPPED CONTAINER FOR CYANOACRYLATE ADHESIVE

[75] Inventor: Tetsuro Maeda, Tokyo, Japan

[73] Assignee: Three Bond Co., Ltd., Tokyo, Japan

[21] Appl. No.: 09/014,564

[22] Filed: Jan. 28, 1998

[30] Foreign Application Priority Data

Jan. 28, 1997 [JP] Japan ..... 9-049571

[51] Int. Cl.[6] ..... A46B 11/00

[52] U.S. Cl. ..... 401/129; 401/122; 401/126; 401/127

[58] Field of Search ..... 401/126, 127, 401/129, 118, 121, 122; 215/12.1

[56] References Cited

U.S. PATENT DOCUMENTS

| | | | |
|---|---|---|---|
| 4,102,945 | 7/1978 | Gleave | 260/879 |
| 4,573,429 | 3/1986 | Cobbs, Jr. et al. | 118/322 |
| 5,284,239 | 2/1994 | Kiricoples | 401/129 |
| 5,480,064 | 1/1996 | Yan | 222/83 |

FOREIGN PATENT DOCUMENTS

| | | | |
|---|---|---|---|
| 0 514 659 A1 | 11/1992 | European Pat. Off. | A45D 34/04 |
| 1186887 | 3/1959 | France . | |
| 8-91419 | 4/1996 | Japan | B65D 51/32 |
| 9108116 | 6/1991 | WIPO . | |
| 9205026 | 4/1992 | WIPO . | |

*Primary Examiner*—Henry J. Recla
*Assistant Examiner*—Tuan Nguyen
*Attorney, Agent, or Firm*—Sughrue, Mion, Zinn, Macpeak & Seas, PLLC

[57] ABSTRACT

A brush-equipped container for a cyanoacrylate adhesive, the container comprising: a container main body comprising a polyolefin resin; and a cap for capping the container main body, which has a brush member provided on the inner side of the cap so that the brush member is housed in the container main body, the brush member comprising a handle and bristles, wherein at least the container main body is coated with a gas-impermeable coating material which is insoluble in the cyanoacrylate and which has poor adhesion property with respect to the cyanoacrylate.

14 Claims, 2 Drawing Sheets

BRUSH-EQUIPPED CONTAINER FOR CYANOACRYLATE ADHESIVE

FIELD OF THE INVENTION

The present invention relates to a brush-equipped container for containing an instantaneous cyanoacrylate adhesive, which container has a cap having a brush with which brush the cyanoacrylate adhesive can be applied.

BACKGROUND OF THE INVENTION

For use as containers for paints, nail polishes, etc., there are containers equipped with a brush provided on the inner side of a cap, so that the liquid contained in the container main body can be applied with the brush. Various kinds of such brush-equipped containers are disclosed, e.g., in JP-A-U-57-57020 (the term "JP-A-U" as used herein means an "unexamined published Japanese utility model application".), JP-A-U-62-18458, JP-A-U-63-199962 and JP-A-U-6-37167.

Cyanoacrylic esters used as the main component of cyanoacrylate adhesives have a feature that they react with water to undergo anionic polymerization, to thereby cure in a short period of time. Containers for containing cyanoacrylate adhesives are hence required to function to prevent moisture inclusion. Consequently, conventional containers on the market which contain cyanoacrylate adhesives are completely sealed containers so as to prevent moisture inclusion in the distribution stages, and the seal must be broken just before use by piercing with, e.g., a needle. In addition, it has been required that cyanoacrylate adhesives be used in such a manner that the adhesives are dropped onto intended areas of adherends to be bonded while keeping the mouths of the cyanoacrylate adhesive containers apart from the adherends in order to avoid contact with moisture adhered to the adherend surfaces.

If cyanoacrylate adhesives are placed in brush-equipped containers as described above, the following problems are caused. Since the container should be opened for every time to apply the adhesive with the brush, moisture in the atmosphere comes into the container. In addition, the moisture adhered to the adherend migrates to the brush during application due to capillarity to cause water inclusion into the cyanoacrylate adhesive contained in the container. As a result, the cyanoacrylate adhesive cures in the container before being used up. Namely, since conventional brush-equipped containers tend to allow moisture to come thereinto, those containers have not been employed as cyanoacrylate adhesive containers.

In bonding using a cyanoacrylate adhesive, it is preferred to apply the cyanoacrylate as thinly as possible onto an adherend to be bonded and then laminate with another adherend. Virtually, however, the cyanoacrylate adhesive is dropped onto an adherend from the container for the reasons described above, and the adherend in such a state is laminated with another adherend.

Therefore, there are cases where, in bonding of a small area, a cyanoacrylate adhesive is unintentionally dropped onto the adherend in an excess amount. The excess cyanoacrylate adhesive overflows from the bonded area and undergoes the "whitening phenomenon," which is peculiar to cyanoacrylate adhesives, to impair the appearance of areas around the bonded area. In the case where a cyanoacrylate adhesive is used for bonding of wide area, drops of the cyanoacrylate adhesive on an adherend should be scatteringly carried out. If these drops are inadequately scattered, there is a drawback that areas at which the cyanoacrylate adhesive is not intervened are caused within the bonded area so that a bonded surface having uniform bonding strength cannot be obtained.

That is, the application state of a cyanoacrylate adhesive by merely dropping the adhesive to an adherend is not suitable for bonding as compared with the state of a cyanoacrylate adhesive by uniformly applying with, e.g., a brush. Because of this, the use of cyanoacrylate adhesives has been limited to simple bonding operations such as provisional bonding from the standpoints of bonding reliability, etc.

SUMMARY OF THE INVENTION

Accordingly, an object of the present invention is to provide a brush-equipped container with which brush a cyanoacrylate adhesive can be applied to an adherend, and in which container the cyanoacrylate adhesive shows excellent storage stability without curing.

Other objects and effects of the present invention will become apparent from the following description.

The above objectives of the present invention have been achieved by providing a brush-equipped container for a cyanoacrylate adhesive, the container comprising:

a container main body comprising a polyolefin resin; and a cap for capping the container main body, which has a brush member provided on the inner side of the cap so that the brush member is housed in the container main body, the brush member comprising a handle and bristles, wherein at least the container main body is coated with a gas-impermeable coating material which is insoluble in the cyanoacrylate and which has poor adhesion property with respect to the cyanoacrylate.

By coating the container main body with the gas-impermeable coating material as described above, a reaction-inhibiting gas contained in the cyanoacrylate adhesive as one of the components thereof, as described below, is prevented from permeating through and vaporing away out of the container main body.

The gas-impermeable coating material is preferably either a fluororesin or a paraffin wax. The handle of the brush member is preferably made of a polyolefin resin, and the bristles thereof are preferably made of a polyamide resin.

The container main body preferably has a stopper which has a through-hole and which is provided on the mouth portion of the container main body. The through-hole has a lower end opening (the opening nearer to the bottom of the container main body) and an upper end opening (the other opening) and, therebetween, preferably has an opening area small enough to hold a part of the cyanoacrylate adhesive between the inner-wall of the stopper and the handle of the brush member. By taking this constitution, the reaction-inhibiting gas can be prevented from vaporing away through the opening of the main body. The stopper preferably has a conical shape.

DETAILED DESCRIPTION OF THE INVENTION

Figure 1:
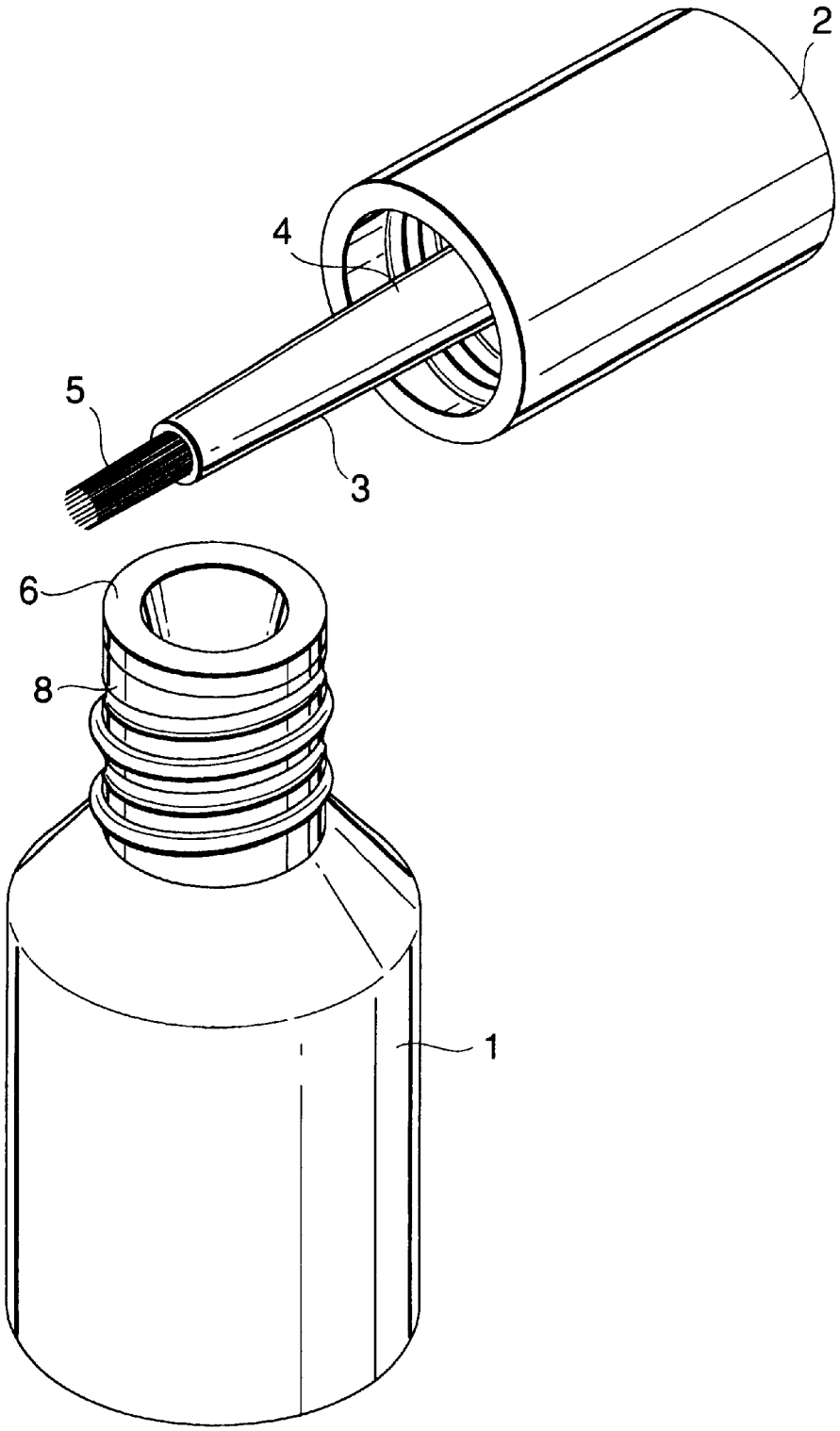
FIG. 1 is a perspective view of a container according to the present invention.

FIG. 1 shows an embodiment of the brush-equipped container of the present invention. In the figure, reference numeral 1 represents a container main body which has a mouth portion 8 on the top thereof. On the mouth portion, a stopper 6 is provided. Reference numeral 2 represents a cap which has a brush member 3 composed of a handle 4 and bristles 5.

Figure 2:
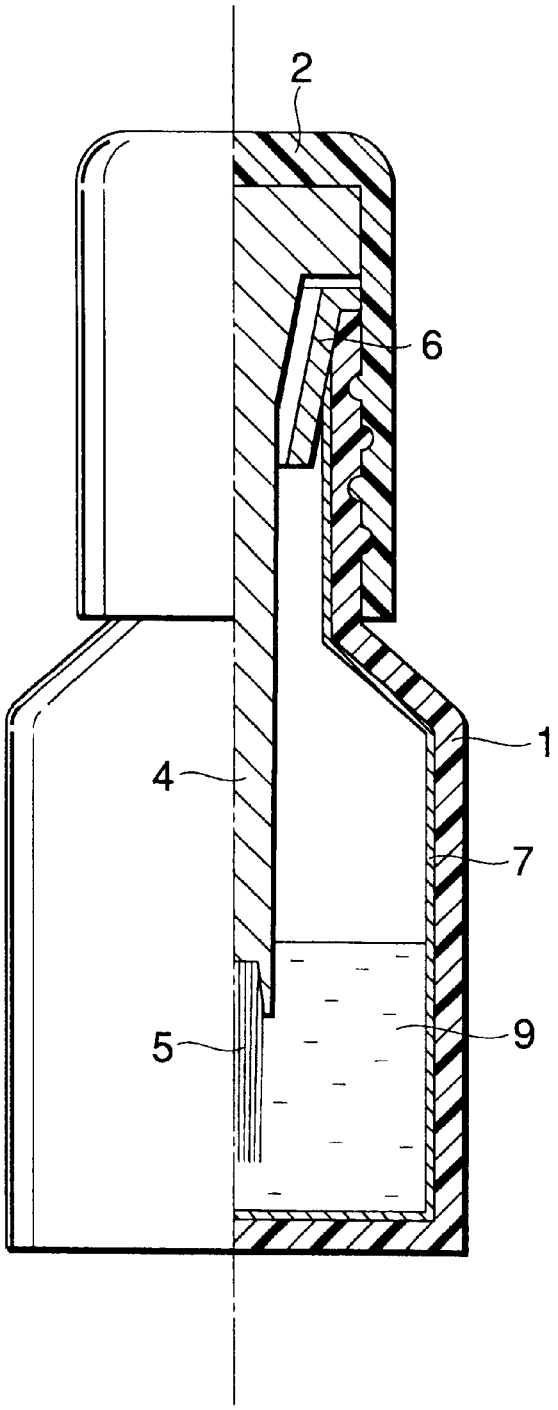
FIG. 2 is a partially sectional view of a container according to the present invention.

FIG. 2 is a partially sectional view of an embodiment of the brush-equipped container of the present invention. Reference numeral 7 represents a gas-impermeable coating material coated on the inner surface of the container main body 1, and reference numeral 9 represents a cyanoacrylate adhesive contained in the container 1.

Cyanoacrylic esters which are the main components of cyanoacrylate adhesives are so reactive that they begin to undergo anionic polymerization merely upon contact with moisture present in the atmosphere or on an adherend surface. Although this highly reactive nature offers the advantage of instantaneous bonding, it leads to drawbacks that cyanoacrylate adhesives are inferior in handleability, suitability for bonding operation, and storage stability.

In order to mitigate these drawbacks, a reaction-inhibiting gas is usually dissolved and contained in cyanoacrylic esters in producing cyanoacrylate adhesives. When a cyanoacrylate adhesive is used for bonding, the reaction-inhibiting gas vapors away out of the adhesive, or the gas undergoes a chemical reaction with water which enters into the adhesive composition to thereby change into another compound. The reaction-inhibiting gas thus disappears from the cyanoacrylate adhesive, upon which the cyanoacrylic ester initiates anionic polymerization to thereby cause bonding thereof. In general, an acid gas such as, e.g., boron trifluoride or sulfur dioxide is used as the reaction-inhibiting gas.

The material of the container main body 1 for a cyanoacrylate adhesive can be selected from polyolefin resins having poor bondability, such as, e.g., polyethylene or polypropylene, from the standpoint of facilitating the opening/closing of the cap. However, as is well known, polyethylene and the like have gas permeability. That is, if a polyolefin container is used, the reaction-inhibiting gas contained in the cyanoacrylate adhesive permeates through and vapors away out of the container. As a result, the storage stability of the cyanoacrylate adhesive is impaired to cause curing of the adhesive in the container.

As described above, brush-equipped containers are susceptible to water inclusion. Therefore, in order for a brush-equipped container to be practically used for containing a cyanoacrylate adhesive, the container should retain an effective amount of the reaction-inhibiting gas therein semipermanently.

If the reaction-inhibiting gas is dissolved in a cyanoacrylate adhesive in an excess amount from the beginning for retaining an effective amount thereof for a long period of time taking into account the amount which vapors away, the initiation of polymerization caused by water inclusion is effectively inhibited. However, it impairs the instantaneous bonding characteristics of the cyanoacrylate adhesive.

In the present invention, the above described problems have been solved by coating the container main body 1 with a gas-impermeable coating material 7 which is insoluble in cyanoacrylic esters and to which the cyanoacrylic esters difficultly adhere, to thereby prevent a reaction-inhibiting gas from permeating through and vaporing away out of the container main body 1. Examples of the gas-impermeable coating material 7 for use in the present invention include fluororesins and paraffin waxes. Although the gas-impermeable coating material is preferably applied to the inner surface of the container, it may be applied to the outer surface alone or to both surfaces.

If a coating material which dissolves in cyanoacrylic esters is used, it may influence the storage stability or adhesive strength of cyanoacrylate adhesives. If the adhesion property of the coating material with respect to cyanoacrylic esters is not poor, this causes a trouble that the brush handle or the cap is bonded to the container main body by the action of cyanoacrylate adhesives.

The brush member 3 attached to the cap for use in the present invention is preferably composed of materials all having poor adhesion property with respect to cyanoacrylate adhesives. If the brush member 3 is not constituted of such a material, there is a possibility that the brush might be bonded to an adherend during application of a cyanoacrylate adhesive to the adherend using the brush. Particularly preferably, the handle 4 of the brush member 3 is made of a polyolefin resin and the bristles 5 of the brush member 3 is made of a polyamide resin.

The reason why a polyamide resin having weakly polar groups is preferred as the material of the bristles in the present invention, as compared to nonpolar polyolefins, has not been elucidated so far. However, the following hypothesis can be used to explain the superiority of polyamide resins as compared to polyolefin resins.

The gas used for inhibiting the anionic polymerization reaction of cyanoacrylic esters (reaction-inhibiting gas) is generally boron trifluoride or sulfur dioxide, both of which are weakly acidic. In contrast, the amide groups of polyamide resins are weakly basic. Therefore, the reaction-inhibiting gas is strongly adsorbed onto the surface of the bristles 5 made of a polyamide resin, whereby the surface of each bristle is covered with the reaction-inhibiting gas. Therefore, even if moisture present on an adherend surface adheres to the bristles 5 due to capillarity, the reaction-inhibiting gas covering the bristle surface prevents the bristles 5 from becoming stiff by the action of the cyanoacrylate adhesive and enables the brush 3 to be repeatedly used for adhesive application to adherends.

The container main body 1 preferably has, on its mouth portion 8, a stopper having a through-hole for inserting therethrough the brush member 3. The through-hole has a lower end opening (the opening nearer to the bottom of the container main body 1) and an upper end opening (the other opening) and, therebetween, preferably has an opening area small enough to hold a part of the cyanoacrylate adhesive between the inner-wall of the stopper and the handle 4 of the brush member 3. This is because reaction-inhibiting gas vapored out of the cyanoacrylate adhesive in the container main body 1 is redissolved and absorbed in the cyanoacrylate adhesive held in the space formed by the inner-wall of the stopper and the handle 4. Thus, the cyanoacrylate adhesive held in that space serves to prevent the gas from escaping through the opening of the stopper.

The stopper preferably has a conical shape as shown in FIG. 2. The reason for this is as follows. The stopper can be used for scraping off the excess cyanoacrylate adhesive adhered to the brush so as to avoid liquid-dropping during application, and the excess cyanoacrylate adhesive thus scrapped off flows down along the conical wall of the stopper. Thus, the conical shape of the stopper 6 has an effect of supplying a fresh cyanoacrylate adhesive each time to the space formed by the wall of the lower end opening and the handle 4.

The material of the container main body 1 for use in the present invention is not particularly limited as long as it is a polyolefin resin which exhibits a poor adhesion property with respect to cyanoacrylate adhesives. However, from the standpoint of moldability, etc., polyethylene is the most preferred material. Either high-density or low-density polyethylene may be used.

The container main body 1 coated with the gas-impermeable coating material 7 can be prepared as follows. A gas-impermeable coating material in the form of a resin solution, which is prepared by dissolving either a fluororesin or a paraffin wax in a solvent such as, e.g., toluene, hexane or xylene, is applied to a polyethylene container having a shape such as that shown in FIG. 1, and then dried, to provide a container main body according to the present invention. Besides the container main body 1, the cap 2 and the brush member 3 may also be coated with the gas-impermeable coating material.

Since paraffin waxes have the property of melting upon application of heat, the gas-impermeable coating material is preferably a fluororesin because of its aging stability. However, since a fluororesin is somewhat unwilling to form a coated film firmly and closely adhered to polyethylene, some specific treatment is preferably performed after application and drying. In the Examples of the present invention described below, a fluororesin coating formed on a polyethylene container main body was treated by cooperation of Fluoro-Seal, Inc. to obtain a container main body.

FIG. 2 shows a partially sectional view of an embodiment of a cap 2 and a brush member comprising a handle 4 and bristles 5 according to the present invention. The cap 2 and the handle 4 are made of polyethylene, while the bristles 5 are made of a polyamide resin (trade name, TYNEX; E.I. du Pont de Nemours & Co.).

A stopper made of polyethylene can be used, which has a conical shape and which has such a lower end opening area that it does not contact with the handle 4 of the brush member 3 and is as narrow as possible, provided that it does not prevent insertion of the bristles 5. The stopper 6 is inserted to the mouth portion 8 of the container main body 1 to be provided thereon. In producing a container according to the present invention, the stopper 6 can also be coated with the gas-impermeable coating material. For example, a fluororesin can be coated on the stopper surface and the coating can be treated by cooperation of Fluoro-Seal, Inc.

It is preferred that a cyanoacrylate adhesive be placed in the container of the present invention in an amount up to a half of the capacity of the container. This is because even when the container is laid and kept lying, the adhesive contained therein in such an amount does not flow out through the through-hole of the stopper. If leakage occurs and the leaked cyanoacrylate adhesive cures at and adheres to the threaded part of the cap, the cap cannot be opened for use any longer. Another effect is that since the empty space in the container main body is filled with a gas phase saturated with an evaporated reaction-inhibiting gas, the reaction-inhibiting gas dissolved in the cyanoacrylate adhesive is inhibited from evaporating and thus the decrease of the dissolved gas is inhibited. Furthermore, the cyanoacrylate adhesive is inhibited from curing on the surface of the handle of the brush member. In addition, even when opening the container cause inflow of the atmosphere containing moisture, the moisture undergoes a chemical reaction with the saturated reaction-inhibiting gas in that space, to thereby convert the inflow air to dry air. As a result, the cyanoacrylate contained in the container can be prevented from curing.

The present invention will be described in detail with reference to the following Examples, but the invention should not be construed as being limited thereto.

EXAMPLE 1

A container of Example 1 was produced as follows. A 7-ml polyethylene container and a polyethylene stopper having the shapes shown in FIG. 1, respectively, were coated with a fluororesin by cooperation of Fluoro-Seal, Inc. Into this container, 3 g of a cyanoacrylate adhesive (trade name, Three Bond 1742D; Three Bond Co., Ltd.) was introduced, and the mouth of the container was closed with a cap which was made of polyethylene and which had, on its inner side, a brush member composed of a handle made of polyethylene and bristles made of a polyamide (trade name, TYNEX; E.I. du Pont de Nemours & Co.). Thus, a container containing a cyanoacrylate was prepared.

EXAMPLE 2

A container of Example 2 containing a cyanoacrylate adhesive was prepared in the same manner as in Example 1, except that in place of the fluororesin coating material used in Example 1, a 10% toluene solution of a paraffin wax was applied to both the polyethylene container main body and the polyethylene stopper and dried to form a paraffin wax coating film.

COMPARATIVE EXAMPLE 1

In order to demonstrate the effects of the present invention, a container of Comparative Example 1 containing a cyanoacrylate adhesive was prepared in the same manner as in Example 1, except that the coating with a fluororesin conducted in Examples 1 was omitted. Thus, a comparative container through which the reaction-inhibiting gas permeates and vapors away was prepared.

COMPARATIVE EXAMPLE 2

A container of Comparative Example 2 was produced as follows. A commercial glass container for a nail polish was washed with acetone several times and dried. The inner surface of the glass container was coated with a paraffin wax in the same manner as in Example 2. Into this glass container, 5 g of a cyanoacrylate was introduced, which amount corresponded to a half of the capacity of the container. Subsequently, the mouth of the container was closed with the cap having a brush member, which had been originally attached to the container, after washing with acetone and drying. Thus, a glass container containing a cyanoacrylate and having a paraffin wax coating film formed on the inner surface thereof was prepared.

The containers of Examples 1 and 2 and Comparative Examples 1 and 2 were subjected to a 70° C. accelerated deterioration test to examine suitability for repeated use and the stability of the cyanoacrylate adhesive contained therein. In the test, the test containers of the Examples and Comparative Examples were placed in a thermostatic chamber set at 70° C., and examined every day for as to whether the cap was openable/closable or not and whether the bristles became stiff or not, and for viscosity change of the cyanoacrylate adhesive contained therein. The results obtained are shown in Table 1.

TABLE 1

| Number of days passing in accelerated test | Viscosity change with time *1 | Stiffening of bristles | Cap opening/closing | Viscosity change with time *1 | Stiffening of bristles | Cap opening/closing |
|---|---|---|---|---|---|---|
| | | Example 1 | | | Example 2 | |
| 1 | 26.5 | not occurred | possible | 26.5 | not occurred | possible |
| 2 | 26.5 | not occurred | possible | 26.5 | not occurred | possible |
| 3 | 26.5 | not occurred | possible | 26.5 | not occurred | possible |
| 4 | 26.5 | not occurred | possible | 27.0 | not occurred | possible |
| 5 | 26.5 | not occurred | possible | 27.5 | not occurred | possible |
| 6 | 27.0 | not occurred | possible | 28.0 | not occurred | possible |
| 7 | 27.0 | not occurred | possible | 29.0 | not occurred | possible |
| | | Comparative Example 1 | | | Comparative Example 2 | |
| 1 | 26.5 | not occurred | possible | 26.5 | not occurred | possible |
| 2 | 27.0 | not occurred | possible | 26.5 | stiffened | possible |
| 3 | 27.0 | not occurred | possible | 26.5 | stiffened | possible |
| 4 | 29.0 | stiffened | possible | *2 | *2 | impossible |
| 5 | 32.5 | stiffened | possible | *2 | *2 | impossible |
| 6 | 60.0 | stiffened | possible | *2 | *2 | impossible |
| 7 | cured | stiffened | possible | *2 | *2 | impossible |

Note)
*1 unit: cps
*2 Measurement and observation were impossible because the cap could not be took off.

The cyanoacrylate adhesive contained in the glass container of Comparative Example 2 underwent no viscosity increase because the glass container was impermeable with respect to the reaction-inhibiting gas. However, the cap opening/closing operation resulted in peeling of the paraffin wax coating film from the mouth portion. Once the peeling occurred, the mouth portion of the container main body was bonded to the cap with the cyanoacrylate adhesive because of the adhesion property of glass with cyanoacrylates, and the cap would not open thereafter.

The container of Comparative Example 1, which was not coated with a gas-impermeable coating material, was free from the undesirable cap/mouth bonding caused by adhesive curing, because the container main body and the cap both were made of polyethylene. However, since the reaction-inhibiting gas permeated through and escaped from the container, the cyanoacrylate adhesive underwent a considerable increase in viscosity and finally cured within the container. The bristles of the brush member stiffened on the fourth day.

The containers of Examples 1 and 2 according to the present invention were free from the above described problems.

The container main body for use in the present invention is effective in preventing a reaction-inhibiting gas, which is used for inhibiting polymerization of a cyanoacrylic ester, from permeating therethrough and escaping therefrom. Further, the empty space in the container is filled with a vapor layer saturated with the reaction-inhibiting gas and this vapor layer, which overlies the cyanoacrylate adhesive, serves to maintain the amount of the reaction-inhibiting gas dissolved in the cyanoacrylate adhesive. As a result, a cyanoacrylate adhesive contained in the container of the present invention has excellent storage stability. Furthermore, the container can be provided on its mouth portion with a stopper. This constitution has the effect of preventing the reaction-inhibiting gas from escaping through the mouth portion, because the space between the handle of the brush member and the inner-wall of the stopper is filled with the cyanoacrylate adhesive.

Consequently, even when moisture present on an adherend adheres to the bristles of the brush member due to capillarity and comes into the container, this water immediately undergoes a chemical reaction with the reaction-inhibiting gas, to thereby prevent the cyanoacrylate from curing in the container. Thus, the brush member can be repeatedly used to apply the cyanoacrylate adhesive.

Moreover, since the container main body for use in the present invention retains the intact poor bondability of the polyolefin resin, of which the container main body is made, the cap having a brush member is not bonded to the mouth portion of the container main body and can be opened and closed many times.

In the case where the brush member has bristles made of a polyamide resin, the reaction-inhibiting gas is chemically adsorbed onto the bristles more tenaciously than onto non-polar polyolefin resins because the polyamide resin has weakly basic polar groups in the molecule. Since the surface of each bristle is thus covered with the reaction-inhibiting gas, the bristles are prevented from being stiffened by the curing of the cyanoacrylate adhesive, even when the brush member is used to apply the cyanoacrylate adhesive to an adherend having a large amount of moisture adhered to the surface thereof and the moisture migrates to the bristles.

While the invention has been described in detail and with reference to specific examples thereof, it will be apparent to one skilled in the art that various changes and modifications can be made therein without departing from the spirit and scope thereof.

What is claimed is:

1. A brush-equipped container for a cyanoacrylate adhesive, said container comprising:

a container main body comprising a polyolefin resin; and a cap for capping said container main body, which has a brush member provided on the inner side of said cap so that said brush member is housed in said container main body, said brush member comprising a handle and bristles, wherein at least the container main body is coated with a gas-impermeable coating material which is insoluble in the cyanoacrylate and which has poor adhesion property with respect to the cyanoacrylate.

2. The brush-equipped container of claim 1, wherein said coating material is a fluororesin or a paraffin wax.

3. The brush-equipped container of claim 1, wherein the handle of said brush member comprises a polyolefin resin.

4. The brush-equipped container of claim 1, wherein the bristles of said brush member comprise a polyamide resin.

5. The brush-equipped container of claim 1, wherein the handle of said brush member comprises a polyolefin resin and the bristles of said brush member comprise a polyamide resin.

6. The brush-equipped container of claim 1, wherein the container main body has, on its mouth portion, a stopper having a through-hole for inserting therethrough said brush member.

7. The brush-equipped container of claim 6, wherein the through-hole has, between a lower end opening and an upper end opening, an opening area small enough to hold a part of the cyanoacrylate adhesive between the inner-wall of the stopper and the handle of the brush member.

8. The brush-equipped container of claim 6, wherein said stopper has a conical shape.

9. The brush-equipped container of claim 6, wherein said coating material is also coated on the stopper surface.

10. The brush-equipped container of claim 1, wherein said coating material is coated on the inner surface of said container main body.

11. The brush-equipped container of claim 1, wherein said coating material is coated on the outer surface of said container main body.

12. The brush-equipped container of claim 1, wherein said coating material is coated on both the inner and outer surfaces of said container main body.

13. The brush-equipped container of claim 1, wherein said coating material is also coated on the surface of said brush member.

14. The brush-equipped container of claim 1, wherein said coating material is also coated on the cap surface.

* * * * *